US008544525B2

(12) United States Patent
Zhu

(10) Patent No.: US 8,544,525 B2
(45) Date of Patent: Oct. 1, 2013

(54) BIDIRECTIONALLY OPERABLE/SWITCHABLE PULL CORD MECHANISM FOR A WINDOW SHADE

(76) Inventor: Xiang-Rong Zhu, Flatad-Tongnamahjardim (CN)

( * ) Notice: Subject to any disclaimer, the term of this patent is extended or adjusted under 35 U.S.C. 154(b) by 186 days.

(21) Appl. No.: 13/236,719

(22) Filed: Sep. 20, 2011

(65) Prior Publication Data

US 2012/0285634 A1 Nov. 15, 2012

(51) Int. Cl.

| | |
|---|---|
| ***A47G 5/02*** | (2006.01) |
| ***A47H 1/00*** | (2006.01) |
| ***E06B 9/56*** | (2006.01) |

(52) U.S. Cl.

USPC ..... 160/321

(58) Field of Classification Search

USPC ..... 160/340, 168.1 V, 168.1 P, 176.1 V, 160/178.1 V, 321, 345; 254/391

See application file for complete search history.

(56) References Cited

U.S. PATENT DOCUMENTS

| | | | | |
|---|---|---|---|---|
| 826,727 | A * | 7/1906 | Koorie | 188/64 |
| 2,544,086 | A * | 3/1951 | Herrington | 24/136 A |
| 2,991,526 | A * | 7/1961 | Kuebler | 24/115 R |
| 3,050,803 | A * | 8/1962 | Hulterstrum | 24/129 R |
| 3,123,182 | A * | 3/1964 | Malone et al. | 188/65.1 |
| 3,756,565 | A * | 9/1973 | Sakai | 254/391 |
| 3,931,846 | A * | 1/1976 | Zilver | 160/178.2 |
| 4,502,668 | A * | 3/1985 | Dodge, Jr. | 254/391 |
| 4,513,805 | A | 4/1985 | Mase | 160/299 |
| 4,542,884 | A * | 9/1985 | Dodge, Jr. | 254/391 |
| 4,813,469 | A * | 3/1989 | Scott | 160/178.2 |
| 4,878,269 | A * | 11/1989 | Anscher et al. | 24/115 G |
| 5,167,268 | A * | 12/1992 | Mao | 160/178.2 |
| 5,465,779 | A | 11/1995 | Rozon | 160/168.1 |
| 5,595,232 | A * | 1/1997 | Benthin | 160/178.1 R |
| 6,196,293 | B1 * | 3/2001 | Lee | 160/168.1 V |
| 6,516,860 | B1 | 2/2003 | Weaver et al. | 160/168.1 |
| 7,779,886 | B2 * | 8/2010 | Ganzi | 160/168.1 R |
| 8,376,022 | B2 * | 2/2013 | Lin | 160/321 |
| 2004/0261958 | A1 | 12/2004 | Sugiyama et al. | 160/296 |
| 2006/0048907 | A1 * | 3/2006 | Rice et al. | 160/178.1 V |

(Continued)

FOREIGN PATENT DOCUMENTS

| | | |
|---|---|---|
| CN | 2251321 | 4/1997 |
| CN | 2329751 | 7/1999 |
| CN | 2725495 | 9/2005 |
| CN | 101025073 | 8/2007 |
| CN | 101139909 | 3/2008 |
| CN | 101139910 | 3/2008 |

(Continued)

*Primary Examiner* — Blair M Johnson
*Assistant Examiner* — Jaime F Cardenas-Garcia
(74) *Attorney, Agent, or Firm* — Alan Kamrath; Kamrath IP Lawfirm, P.A.

(57) ABSTRACT

A pull cord mechanism for a window shade includes a frame (1), a shade (2), a shade driving mechanism (3), and a bead chain or pull cord (4) for driving the shade driving mechanism (3). A sliding block (7) is slideably received in a barrel (5) receiving the pull cord (4). A handle (8) is mounted outside of the barrel (5) and connected to the sliding block (7). A pivotal plate (12*a*) is pivotably supported in a passageway (11) of the sliding block (7). A recess is defined in one of a rear side (12*a*1) of the pivotal plate (12*a*) and a wall (11*a*) of the passageway (11) facing the rear side (12*a*1). A positioning block (12*c*) is located between the rear side (12*a*1) of the pivotal plate (12*a*) and the wall (11*a*) of the passageway (11). A gear (12*b*) is located between the section (4*a*) of the pull cord (4) and a front side (12*a*2) of the pivotal plate (12*a*) opposite to the rear side (12*a*1).

10 Claims, 5 Drawing Sheets

(56) References Cited

U.S. PATENT DOCUMENTS

| | | | | |
|---|---|---|---|---|
| 2010/0314054 | A1 | 12/2010 | Zhu | 160/294 |
| 2011/0011543 | A1 | 1/2011 | Zhu | 160/312 |
| 2012/0160630 | A1* | 6/2012 | Cannaverde | 192/71 |
| 2012/0285634 | A1* | 11/2012 | Zhu | 160/340 |
| 2012/0285635 | A1* | 11/2012 | Zhu | 160/340 |

FOREIGN PATENT DOCUMENTS

| | | |
|---|---|---|
| CN | 101240691 | 8/2008 |
| CN | 201106396 | 8/2008 |
| CN | 201148833 | 11/2008 |
| CN | 201152137 | 11/2008 |
| CN | 101476443 | 7/2009 |
| WO | WO2006133639 | 12/2006 |

* cited by examiner

BIDIRECTIONALLY OPERABLE/SWITCHABLE PULL CORD MECHANISM FOR A WINDOW SHADE

BACKGROUND OF THE INVENTION

The present invention relates to a pull cord mechanism for a window shade.

The endless bead chains or pull cords of currently available pull cord mechanisms for driving the shade driving mechanisms to release/wind the window shades or to move the window shades in a horizontal direction are exposed. Driven by the playful nature, a child often plays the bead chain or pull cord as a toy. However, the bead chain or pull cord is soft and has two sections connected to the window shade, such that the bead chain or pull cord is liable to tangle the child by the neck and, thus, causes danger, which potential risk has not yet been effectively solved by now.

BRIEF SUMMARY OF THE INVENTION

An objective of the present invention is to provide a bidirectionally operable/switchable pull cord mechanism for a window shade capable of effectively preventing the bead chain or pull cord from tangling a child.

The present invention fulfills the above objective by providing a bidirectionally operable/switchable pull cord mechanism including a frame, a shade, a shade driving mechanism, and an endless bead chain or pull cord for driving the shade driving mechanism. The shade driving mechanism is fixed to the frame and drives the shade to release/wind or to move in a horizontal direction. A barrel is mounted to the frame at a location corresponding to the bead chain or pull cord. The barrel includes a peripheral wall having a slit extending in an axial direction. A sliding block is slideably received in the barrel. A handle is mounted outside of the barrel. The sliding block is connected to the handle by a link extending through the slit. The bead chain or pull cord is received in the barrel. A fixed pulley is mounted to an end of the barrel. The bead chain or pull cord is wound around the fixed pulley. The sliding block includes a passageway in an intermediate portion thereof. A follower device is mounted in the passageway. The sliding block is connected by the follower device to a section of the bead chain or pull cord extending through the passageway. The follower device includes a pivotal plate, a gear, and a positioning block. The pivotal plate is pivotably supported in the passageway by a shaft. The passageway has a wall facing a rear side of the pivotal plate. A recess is defined in one of the rear side of the pivotal plate and the wall of the passageway. The positioning block is located between the rear side of the pivotal plate and the wall of the passageway. The gear is located between the section of the bead chain or pull cord and a front side of the pivotal plate opposite to the rear side.

In operation, in a case that the positioning block is moved to a lower end of the rear side the pivotal plate, the pivotal plate and the section of the bead chain or pull cord define a trumpet-shaped space having a larger, upper opening and a smaller, lower opening. The sliding block can be moved upward towards the larger, upper opening through operation of the handle. Under actuation by the pivotal plate and the bead chain or pull cord, the gear moves downward towards the smaller, lower opening. The bead chain or pull cord is now securely sandwiched between the gear and the sliding block, allowing joint movement of the bead chain or pull cord and the sliding block. The bead chain or pull cord drives the shade driving mechanism to release the shade while the sliding block is moved upward through operation of the handle. On the other hand, when the sliding block is moved downward through operation of the handle, the gear is moved upward towards the larger, upper opening under actuation by the pivotal plate and the bead chain or pull cord, disengaging the gear from the bead chain or pull cord. Thus, the bead chain or pull cord is not moved when the sliding block and the handle are moved downward. By repeatedly moving the handle and the sliding block upward and downward with the positioning block in the lower position, the bead chain or pull cord is intermittently moved in a direction to release the shade.

In another case that the positioning block is moved to an upper end of the rear side of the pivotal plate, the pivotal plate and the section of the bead chain or pull cord define a trumpet-shaped space having a smaller, upper opening and a larger, lower opening. The sliding block can be moved downward towards the larger, lower opening through operation of the handle. Under actuation by the pivotal plate and the bead chain or pull cord, the gear moves upward towards the smaller, upper opening. The bead chain or pull cord is now securely sandwiched between the gear and the sliding block, allowing joint movement of the bead chain or pull cord and the sliding block. The bead chain or pull cord drives the shade driving mechanism to wind the shade while the sliding block is moved downward through operation of the handle. On the other hand, when the sliding block is moved upward through operation of the handle, the gear is moved downward towards the larger, lower opening under actuation by the pivotal plate and the bead chain or pull cord, disengaging the gear from the bead chain or pull cord. Thus, the bead chain or pull cord is not moved when the sliding block and the handle are moved upward. By repeatedly moving the handle and the sliding block upward and downward with the positioning block in the upper position, the bead chain or pull cord is intermittently moved in a reverse direction to wind the shade.

To allow smooth rotation of the gear along the rotating board, the front side of the pivotal plate includes a plurality of teeth meshed with the gear.

To allow repeated smooth movement of the bead chain or pull cord, the handle is a sleeve including a hole having a shape of cross sections corresponding to that of the cross sections of the barrel.

To allow easy adjustment of the position of the positioning block, the link includes a channel in communication with the passageway. An actuating rod is received in the channel and connected to the positioning block. In use, the positioning block is moved to the desired position through the actuating rod.

The sleeve includes a peripheral wall having a slot. Two sidewalls of the slot are respectively and securely connected to two sides of the link having the channel. An end of the actuating rod extends outside of the slot. A button is fixed to the end of the actuating rod outside of the slot.

To provide the bead chain or pull cord with a certain tension for ensuring smooth, circulating motion of the bead chain or pull cord, a pulley seat is mounted to the end of the barrel. The fixed pulley is rotatably mounted to the pulley seat. A compression spring is mounted between the pulley seat and the barrel.

To provide the barrel with a guiding function, the hole of the barrel is cylindrical. The sliding block includes two ends each having an end face. Each of the end faces of the sliding block has a curve corresponding to that of the inner periphery of the hole of the barrel.

To increase the sliding effect of the sleeve, the sleeve and the sliding block are made of plastic or aluminum alloy.

Compared to the current techniques, the present invention can effectively prevent the bead chain or pull cord from tangling a child.

The present invention will become clearer in light of the following detailed description of illustrative embodiments of this invention described in connection with the drawings.

DETAILED DESCRIPTION OF THE INVENTION

Figure 1:
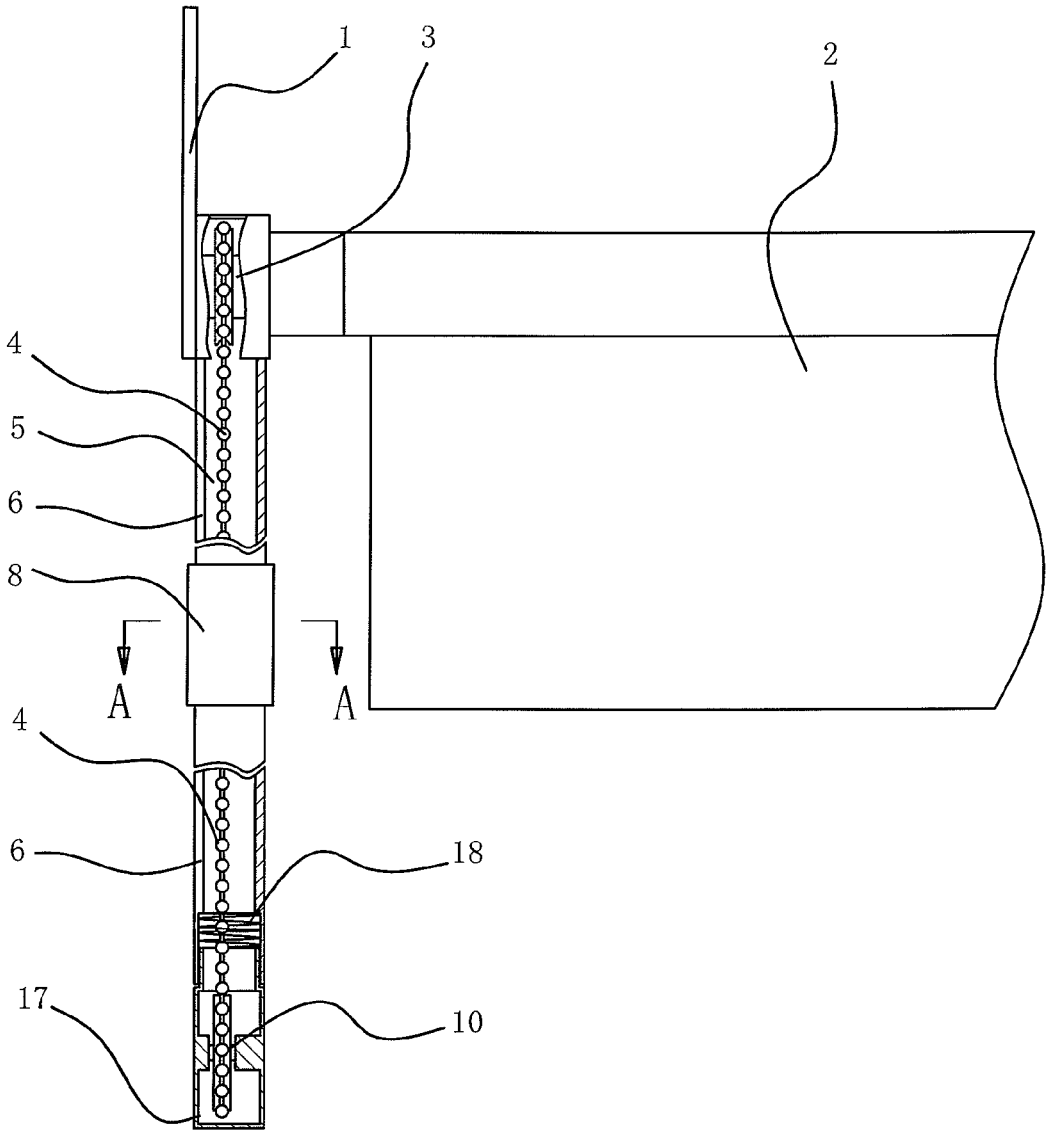
FIG. 1 shows a schematic view of a pull cord mechanism for a window shade according to the present invention.
Figure 2:
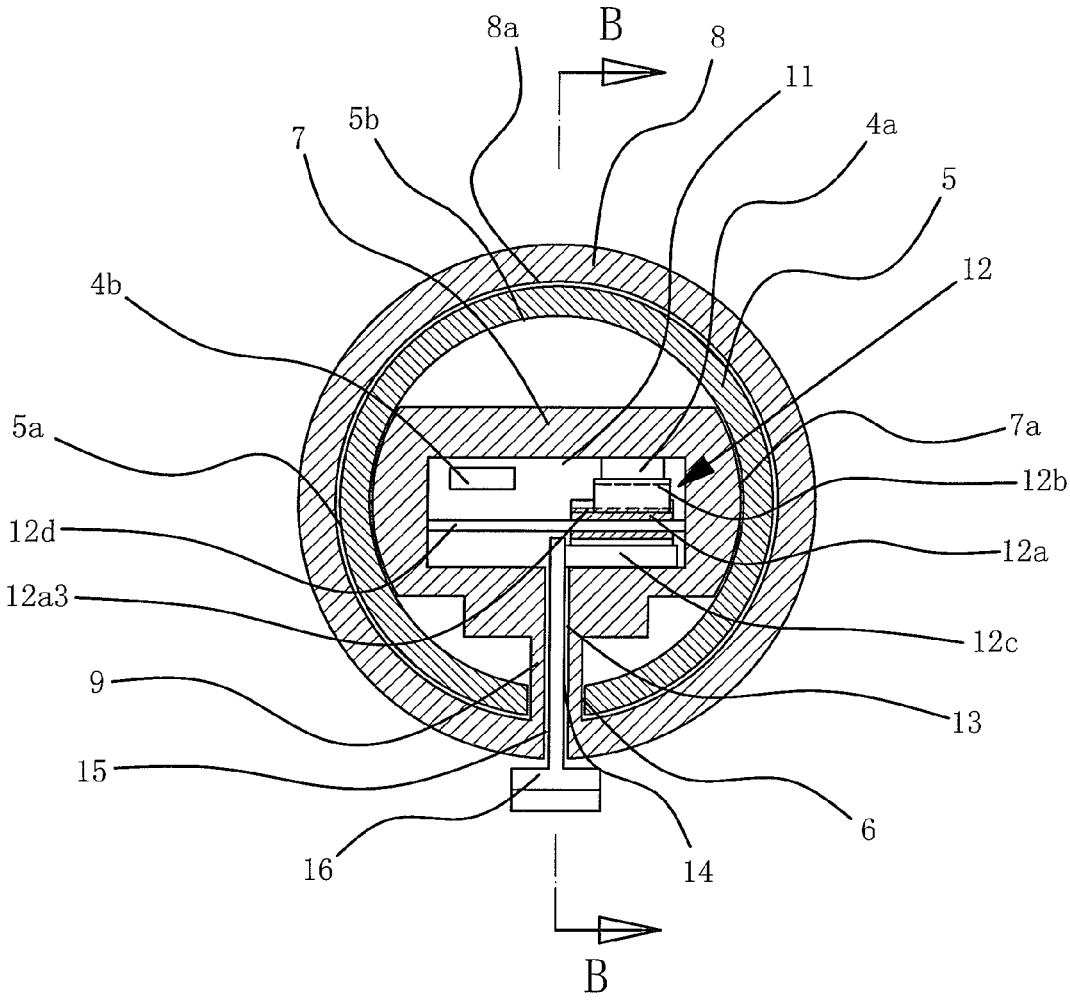
FIG. 2 shows a cross sectional view taken along section line A-A of FIG. 1.
Figure 3:
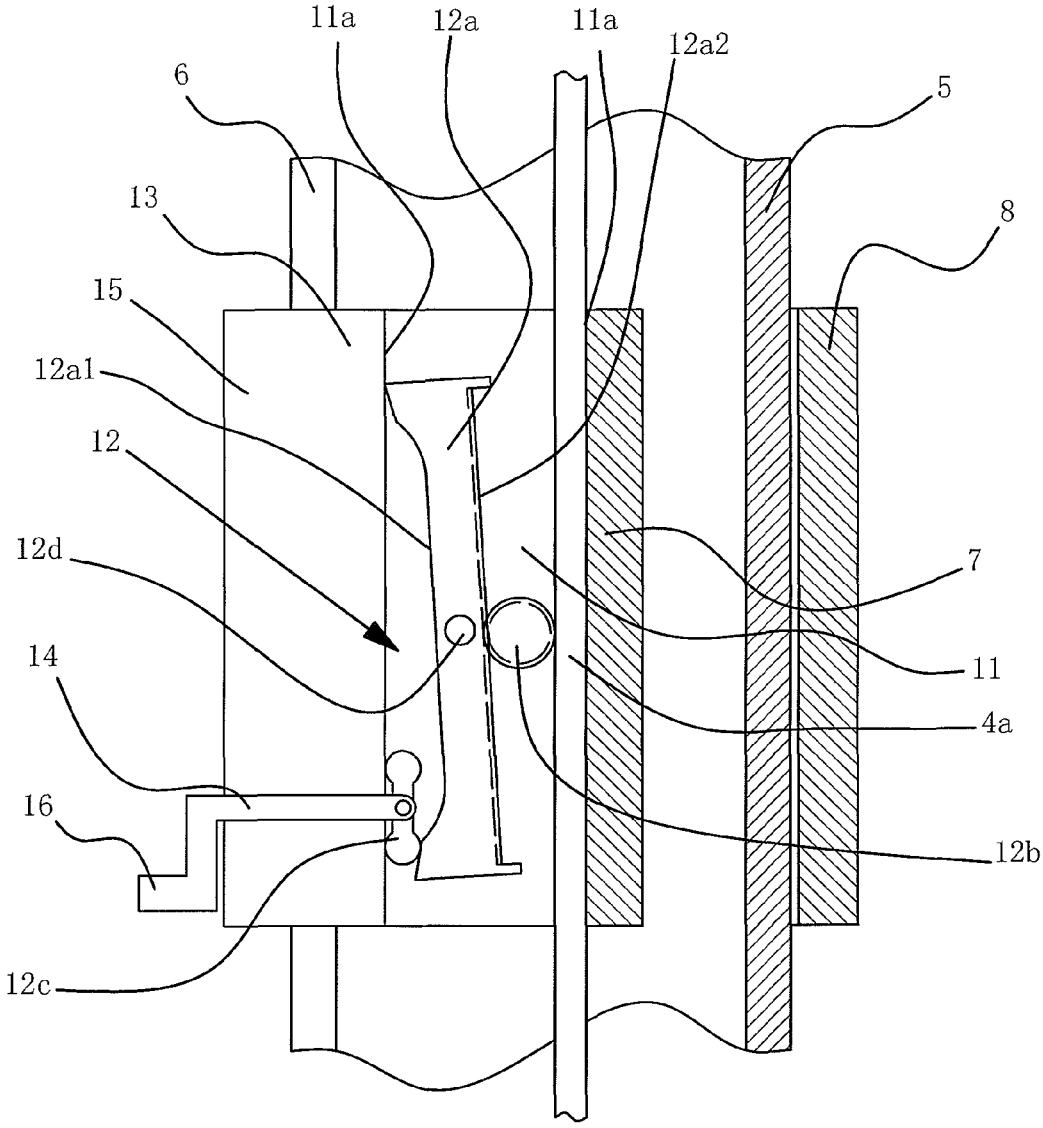
FIG. 3 shows a cross sectional view taken along section line B-B of FIG. 2.
Figure 4:
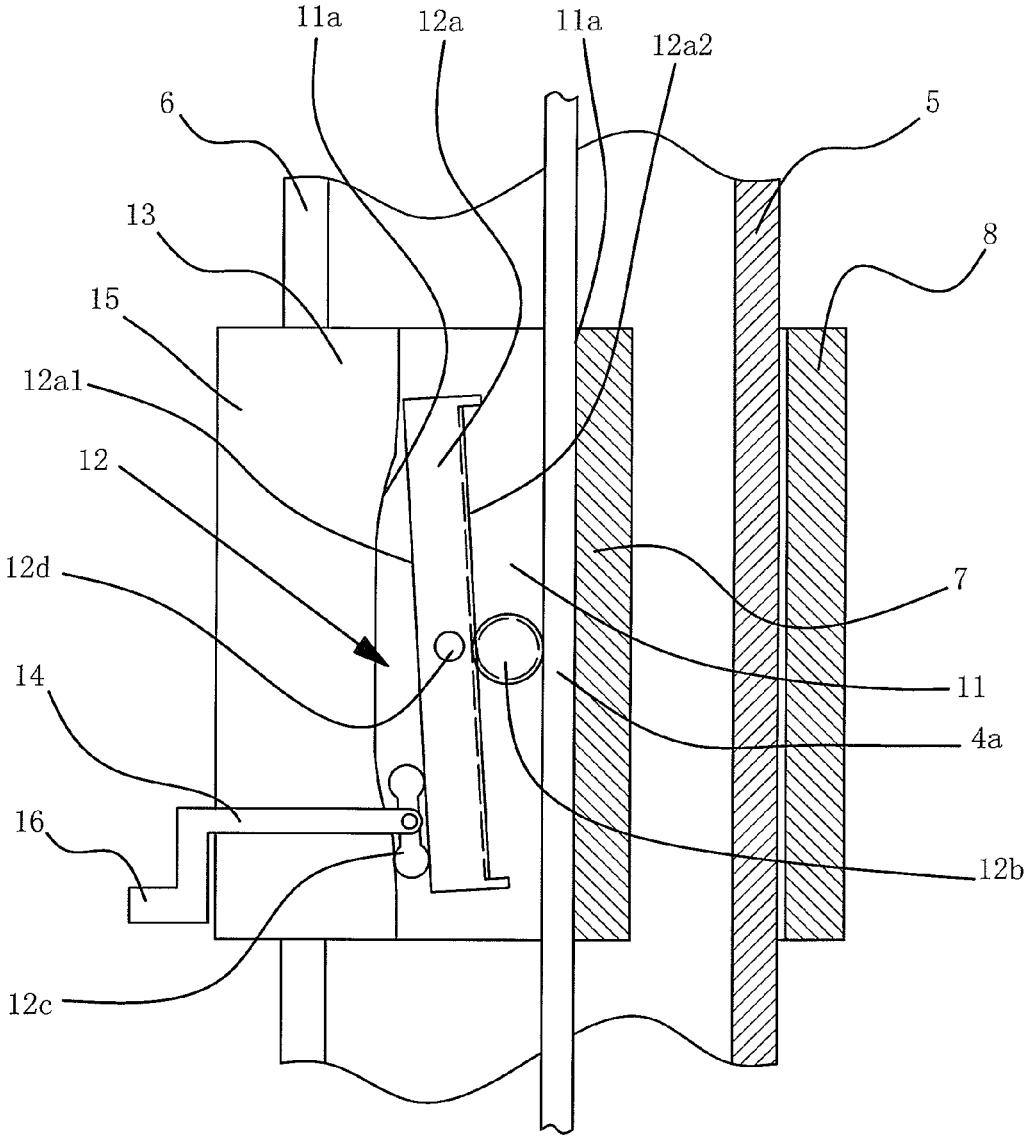
FIG. 4 shows a view similar to FIG. 3, illustrating a second embodiment of the pull cord mechanism.

A pull cord mechanism for a window shade includes a frame 1, a shade 2, a shade driving mechanism 3, and an endless bead chain or pull cord 4 for driving the shade driving mechanism 3. The shade driving mechanism 3 is fixed to the frame 1 and drives the shade 2 to release/wind or to move in a horizontal direction. Particularly, a barrel 5 is mounted to the frame 1 at a location corresponding to the bead chain or pull cord 4. The barrel 5 includes a peripheral wall having a slit 6 extending in an axial direction. A sliding block 7 is slideably received in the barrel 5. A handle 8 is mounted outside of the barrel 5. The sliding block 7 is connected to the handle 8 by a link 9 extending through the slit 6. The bead chain or pull cord 4 is received in the barrel 5. A fixed pulley 10 is mounted to an end of the barrel 5. The bead chain or pull cord 4 is wound around the fixed pulley 10. The sliding block 7 includes a passageway 11 in an intermediate portion thereof. A follower device 12 is mounted in the passageway 11. The sliding block 7 is connected by the follower device 12 to a section 4*a* of the bead chain or pull cord 4 extending through the passageway 11. The other section 4*b* of the bead chain or pull cord 4 is also received in the passageway 11. The follower device 12 includes a pivotal plate 12*a*, a gear 12*b*, and a positioning block 12*c*. The pivotal plate 12*a* is pivotably supported in the passageway 11 by a shaft 12*d*. The pivotal plate 12*a* includes a rear side 12*a*1 having a recess (FIG. 3). Alternatively, a wall 11*a* of the passageway 11 facing the rear side 12*a*1 of the pivotal plate 12*a* has a recess (FIG. 4). The positioning block 12*c* is located between the rear side 12*a*1 of the pivotal plate 12*a* and the wall 11*a* of the passageway 11. The gear 12*b* is located between the section 4*a* of the bead chain or pull cord 4 and a front side 12*a*2 of the pivotal plate 12*a* opposite to the rear side 12*a*1. The shape of the cross sections 5*a* of the barrel 5 is one of square, rectangular, circular, elliptic, polygonal, and plum blossom-shaped.

The front side 12*a*2 of the pivotal plate 12*a* includes a plurality of teeth 12*a*3 meshed with the gear 12*b*.

The handle 8 is a sleeve having a hole 8*a*. The hole 8*a* has a shape of cross sections corresponding to that of the cross sections 5*a* of the barrel 5.

The link 9 includes a channel 13 in communication with the passageway 11. An actuating rod 14 is received in the channel 13 and connected to the positioning block 12*c*. The sleeve 8 includes a peripheral wall having a slot 15. Two sidewalls of the slot 15 are respectively and securely connected to two sides of the link 9 having the channel 13. An end of the actuating rod 14 extends outside of the slot 15. A button 16 is fixed to the end of the actuating rod 14 outside of the slot 15.

A pulley seat 17 is mounted to the end of the barrel 5. The fixed pulley 10 is rotatably mounted to the pulley seat 17. A compression spring 18 is mounted between the pulley seat 17 and the barrel 5.

The hole 5*b* of the barrel 5 is cylindrical. The sliding block 7 includes two ends each having an end face 7*a*. Each of the end faces 7*a* of the sliding block 7 has a curve corresponding to that of the inner periphery of the hole 5*b* of the barrel 5. The sliding block 7, the link 9, and the handle 8 are integrally formed of plastic by injection molding or integrally formed by processing aluminum alloy. The barrel 5 is made of aluminum alloy or plastic.

In operation, in a case that the positioning block 12*c* is moved to a lower end of the rear side 12*a*1 of the pivotal plate 12*a*, the pivotal plate 12*a* and the section 4*a* of the bead chain or pull cord 4 define a trumpet-shaped space having a larger opening (the upper one in FIG. 3) and a smaller opening (the lower one in FIG. 3). The sliding block 7 can be moved upward towards the larger, upper opening through operation of the handle 8. Under actuation by the pivotal plate 12*a* and the bead chain or pull cord 4, the gear 12*b* moves downward towards the smaller, lower opening. The bead chain or pull cord 4 is now securely sandwiched between the gear 12*b* and the sliding block 7, allowing joint movement of the bead chain or pull cord 4 and the sliding block 7. The bead chain or pull cord 4 drives the shade driving mechanism 3 to release the shade 2 while the sliding block 7 is moved upward through operation of the handle 8. On the other hand, when the sliding block 7 is moved downward through operation of the handle 8, the gear 12*b* is moved upward towards the larger, upper opening under actuation by the pivotal plate 12*a* and the bead chain or pull cord 4, disengaging the gear 12*b* from the bead chain or pull cord 4. Thus, the bead chain or pull cord 4 is not moved when the sliding block 7 and the handle 8 are moved downward. By repeatedly moving the handle 8 and the sliding block 7 upward and downward with the positioning block 12*c* in the lower position shown in FIG. 3, the bead chain or pull cord 4 is intermittently moved in a direction to release the shade 2.

Figure 3A:
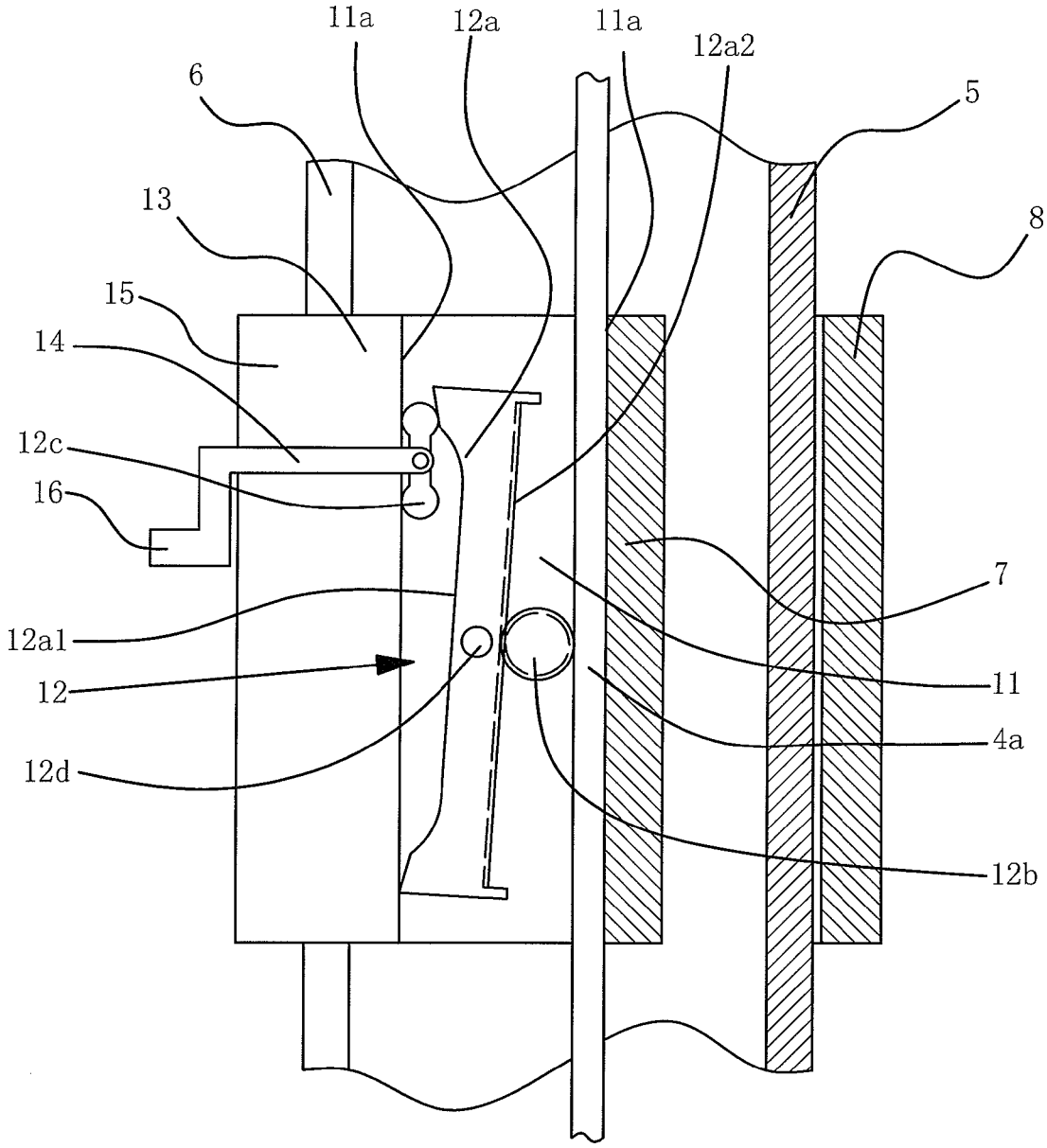
FIG. 3A shows a cross sectional view similar to FIG. 3, with a positioning block moved to an upper position.

In another case that the positioning block 12*c* is moved to an upper end of the rear side 12*a*1 of the pivotal plate 12*a*, the pivotal plate 12*a* and the section 4*a* of the bead chain or pull cord 4 define a trumpet-shaped space having a smaller opening (the upper one in FIG. 3A) and a larger opening (the lower one in FIG. 3A). The sliding block 7 can be moved downward towards the larger, lower opening through operation of the handle 8. Under actuation by the pivotal plate 12*a* and the bead chain or pull cord 4, the gear 12*b* moves upward towards the smaller, upper opening. The bead chain or pull cord 4 is now securely sandwiched between the gear 12*b* and the sliding block 7, allowing joint movement of the bead chain or pull cord 4 and the sliding block 7. The bead chain or pull cord 4 drives the shade driving mechanism 3 to wind the shade 2 while the sliding block 7 is moved downward through operation of the handle 8. On the other hand, when the sliding block 7 is moved upward through operation of the handle 8, the gear 12*b* is moved downward towards the larger, lower opening under actuation by the pivotal plate 12*a* and the bead chain or pull cord 4, disengaging the gear 12*b* from the bead chain or pull cord 4. Thus, the bead chain or pull cord 4 is not moved when the sliding block 7 and the handle 8 are moved upward. By repeatedly moving the handle 8 and the sliding block 7 upward and downward with the positioning block 12*c* in the upper position shown in FIG. 3A, the bead chain or pull cord 4 is intermittently moved in a reverse direction to wind the shade 2.

Although specific embodiments have been illustrated and described, numerous modifications and variations are still possible without departing from the essence of the invention. The scope of the invention is limited by the accompanying claims.

The invention claimed is:

1. A bidirectionally operable/switchable pull cord mechanism for a window shade comprising a frame (1), a shade (2), a shade driving mechanism (3), and an endless bead chain or pull cord (4) for driving the shade driving mechanism (3), with the shade driving mechanism (3) fixed to the frame (1) and driving the shade (2) to release/wind or to move in a horizontal direction, with a barrel (5) mounted to the frame (1) at a location corresponding to the bead chain or pull cord (4), with the barrel (5) including a peripheral wall having a slit (6) extending in an axial direction, with a sliding block (7) slideably received in the barrel (5), with a handle (8) mounted outside of the barrel (5), with the sliding block (7) connected to the handle (8) by a link (9) extending through the slit (6), with the bead chain or pull cord (4) received in the barrel (5), with a fixed pulley (10) mounted to an end of the barrel (5), with the bead chain or pull cord (4) wound around the fixed pulley (10), with the sliding block (7) including a passageway (11) in an intermediate portion thereof, with a follower device (12) mounted in the passageway (11), with the sliding block (7) connected by the follower device (12) to a section (4*a*) of the bead chain or pull cord (4) extending through the passageway (11), with the follower device (12) including a pivotal plate (12*a*), a gear (12*b*), and a positioning block (12*c*), with the pivotal plate (12*a*) pivotably supported in the passageway (11) by a shaft (12*d*), with the pivotal plate (12*a*) including a rear side (12*a*1), with the passageway (11) having a wall (11*a*) facing the rear side (12*a*1) of the pivotal plate (12*a*), with a recess defined in one of the rear side (12*a*1) of the pivotal plate (12*a*) and the wall (11*a*) of the passageway (11), with the positioning block (12*c*) located between the rear side (12*a*1) of the pivotal plate (12*a*) and the wall (11*a*) of the passageway (11), with the gear (12*b*) located between the section (4*a*) of the bead chain or pull cord (4) and a front side (12*a*2) of the pivotal plate (12*a*) opposite to the rear side (12*a*1).

2. The bidirectionally operable/switchable pull cord mechanism for a window shade as claimed in claim 1, with the front side (12*a*2) of the pivotal plate (12*a*) including a plurality of teeth (12*a*3), with the plurality of teeth (12*a*3) meshed with the gear (12*b*).

3. The bidirectionally operable/switchable pull cord mechanism for a window shade as claimed in claim 1, with a shape of cross sections (5*a*) of the barrel (5) being one of square, rectangular, circular, elliptic, polygonal, and plum blossom-shaped.

4. The bidirectionally operable/switchable pull cord mechanism for a window shade as claimed in claim 3, with the handle (8) being a sleeve having a hole (8*a*), with the hole (8*a*) having a shape of cross sections corresponding to that of cross sections (5*a*) of the barrel (5).

5. The bidirectionally operable/switchable pull cord mechanism for a window shade as claimed in claim 4, with the link (9) including a channel (13) in communication with the passageway (11), with an actuating rod (14) received in the channel (13) and connected to the positioning block (12*c*), with the sleeve (8) including a peripheral wall having a slot (15), with the slot (15) including two sidewalls respectively and securely connected to two sides of the link (9) having the channel (13).

6. The bidirectionally operable/switchable pull cord mechanism for a window shade as claimed in claim 5, with the actuating rod (14) having an end extending outside of the slot (15), with a button (16) fixed to the end of the actuating rod (14) outside of the slot (15).

7. The bidirectionally operable/switchable pull cord mechanism for a window shade as claimed in claim 1, with a pulley seat (17) mounted to the end of the barrel (5), with the fixed pulley (10) rotatably mounted to the pulley seat (17), with a compression spring (18) mounted between the pulley seat (17) and the barrel (5).

8. The bidirectionally operable/switchable pull cord mechanism for a window shade as claimed in claim 7, with the barrel (5) including a cylindrical hole (5*b*), with the sliding block (7) including two ends each having an end face (7*a*), with each of the end faces (7*a*) of the sliding block (7) having a curve corresponding to that of an inner periphery of the hole (5*b*) of the barrel (5).

9. The bidirectionally operable/switchable pull cord mechanism for a window shade as claimed in claim 8, with the sleeve (8) made of plastic or aluminum alloy, with the sliding block (7) made of aluminum or plastic.

10. The bidirectionally operable/switchable pull cord mechanism for a window shade as claimed in claim 9, with the sliding block (7), the link (9), and the handle (8) integrally formed of plastic by injection molding or integrally formed by processing aluminum alloy, with the barrel (5) made of aluminum alloy or plastic.

* * * * *